US005836758A

United States Patent [19]

Menzel et al.

[11] Patent Number: 5,836,758

[45] Date of Patent: Nov. 17, 1998

[54] RECIPROCATING GRATE FOR THE TREATMENT OF BULK MATERIAL

[75] Inventors: Karl Josef Menzel, Ennigerloh, Germany; Jean-Paul Kauffmann, Chateauneuf-le-Rouge, France

[73] Assignee: Krupp Polysius AG, Germany

[21] Appl. No.: 759,763

[22] Filed: Dec. 3, 1996

[30] Foreign Application Priority Data

Jan. 25, 1996 [DE] Germany ..... 196 02 621.0

[51] Int. Cl.[6] ..... F23H 7/08; F27D 15/02

[52] U.S. Cl. ..... 432/78; 110/281

[58] Field of Search ..... 432/77, 78, 137; 110/281, 285, 289, 290, 291

[56] References Cited

U.S. PATENT DOCUMENTS

| | | | |
|---|---|---|---|
| 3,925,907 | 12/1975 | Heinemann | 432/137 |
| 4,569,437 | 2/1986 | Doerges | 110/281 |
| 4,884,516 | 12/1989 | Linsen | 110/281 |
| 5,419,698 | 5/1995 | Dittmann | 432/78 |

FOREIGN PATENT DOCUMENTS

| | | |
|---|---|---|
| 0537523 | of 0000 | European Pat. Off. . |
| 0677714 | of 0000 | European Pat. Off. . |
| 4417422 | of 0000 | Germany . |

*Primary Examiner*—Teresa J. Walberg
*Assistant Examiner*—Gregory A. Wilson
*Attorney, Agent, or Firm*—Resing, Ethington, Learman & McCulloch, PLLC

[57] ABSTRACT

The reciprocating grate according to the invention for the treatment of bulk material, particularly for cooling hot material by means of gases, comprises a plurality of rows of grate plates disposed behind one another in the longitudinal direction of the grate, of which at least some are moveable to and fro relative to the others, wherein the grate plates of rows of adjacent grate plates overlap each other somewhat like scales. In order that the wear between grate plates moving relative to one another and the requirement for confining air between these grate plates can be kept relatively low, in at least one longitudinal portion of the grate in each case at least two rows of grate plates which are immediately adjacent to one another are jointly movable relative to at least one succeeding row of grate plates.

17 Claims, 1 Drawing Sheet

RECIPROCATING GRATE FOR THE TREATMENT OF BULK MATERIAL

The invention relates to a reciprocating grate for the cooling of bulk material as it is transported along a path over the grate.

BACKGROUND OF THE INVENTION

Reciprocating grates of this type are preferably used for the heat exchange between a bulk material to be treated and suitable treatment gases. A particularly typical application of such a grate is the construction and use as a cooler grate in a grate cooler for cooling hot material, particularly hot cement clinker, burnt lime, hot ore materials or the like. For this purposes cooling gases, particularly cooling air, are passed transversely from below through the layer of material to be cooled. The thrust motion of the rows of grate plates which can be moved to and fro transports the material to be treated or the hot material to be cooled in the longitudinal direction along a path formed by the grate to the outlet end thereof. As a rule in these known reciprocating grate constructions individual stationary rows of grate plates and individual rows of grate plates which can be moved to and fro are disposed in the longitudinal direction of the path so that they alternate with each other and overlap each other somewhat like scales. The reciprocating thrust motion of the movable rows of grate plates ensures the transport over the grate of the bulk material to be treated. Examples of such known reciprocating grates in the form of reciprocating grate coolers are known inter alia from EP-A-0 537 523, EP-A-0 677 714 and DE-A-44 17 422.

Depending upon the abrasiveness of the bulk material to be treated and depending upon the necessary transport or thrust speed, considerable material wear takes place on the grate plates in the gap for movement between the overlapping grate plates of adjacent rows of stationary and movable rows of grate plates. In modern grate plates a significant proportion of the treatment gases or cooling air is generally introduced through the gas openings present in the grate plates themselves into the bulk material to be treated. In addition, however, a certain proportion of so-called confining air is passed through the gaps for movement between the overlapping grate plates which are movable relative to one another in order to cool the gap region, to prevent fine bulk material from falling through and also to avoid the treatment gas from flowing back out of the bed of bulk material into the lower part of the grate. In order for this to be accomplished with as little confining air as possible, the said gaps for movement must be kept as small as possible. Due to the relative or thrust motion of the overlapping grate plates, due to the material wear which has already been mentioned resulting from these thrust motions and due to highly abrasive material being treated, it is generally very difficult to undertake an accurate setting of the gap height and to maintain this gap height for a long time.

SUMMARY OF THE INVENTION

The object of the invention, therefore, is to provide a reciprocating grate of the type referred to which with reliable treatment of the bulk material, particularly effective cooling of hot kiln feed material, as well as with a relatively simple construction by contrast with the known constructions, is distinguished in that the wear between the grate plates which are movable relative to each other and also the quantity of confining air can be significantly reduced.

Whereas in conventional reciprocating grate constructions the individual rows of grate plates disposed adjacent one another in the longitudinal direction of the grate path are alternately stationary (fixed) or movable to and fro in the material transport direction, in the reciprocating grate according to the invention it is proposed that in at least one longitudinal portion of the grate in each case at least two rows of grate plates which are immediately adjacent to one another are jointly movable relative to at least one row of grate plates which succeeds them in the longitudinal direction of the grate plates. Thus if in at least a selected longitudinal portion of the grate in each case at least two rows of grate plates which are immediately adjacent to one another are jointly movable or jointly fixed so as to be stationary in the appertaining reciprocating grate housing, then this means that no relative movement occurs between these rows of grate plates which are co-ordinated in pairs, with the consequence that wear caused by relative or thrust motions cannot occur in this region and that in addition a gap which is present between the movable grate plates of adjacent rows of grate plates for the passage of confining air or confining gas can be reliably kept at the set width or height.

This construction of the reciprocating grate according to the invention quite generally facilitates a plurality of possible ways of co-ordinating and disposing grate plates or rows of grate plates, particularly as regards the number and the facility for jointly moving or fixing immediately adjacent grate plates.

However, for the practical construction of such a reciprocating grate it is particularly preferred according to the invention if in each case two rows of grate plates which are immediately adjacent to one another and are movable to and fro are co-ordinated in pairs and disposed so that in the longitudinal direction of the grate they alternate with two stationary rows of grate plates which are adjacent to one another. In this case it is also generally advantageous for practical reasons to construct at least the greater part of the length of the reciprocating grate, but preferably the entire length of the effective reciprocating grate, in the co-ordinated arrangement last described. This results in halving of the number of gaps for movement between overlapping grate plates which are movable relative to one another of stationary and movable rows of grate plates which are adjacent to one another, which in turn means that as a result the material wear on the grate plates and the requirement for confining air or confining gas can be reduced by up to approximately 50%.

In the co-ordinated arrangement, alternating pairs of stationary and movable rows of grate plates it is possible to provide for a particularly accurate setting of the gaps for movement. Thus it may be particularly overlap and are movable relative to one another and are adjacent to one another in the longitudinal direction of the grate are disposed above one another while maintaining an adjustable gap for movement. In this case a further advantage is produced since the grate plates of two immediately adjacent stationary rows of grate plates can in each case be adjusted by—separately or independently of one another about a common pivot axis which extends substantially at right angles to the longitudinal axis of the grate and through the contact points of these grate plates which overlap one another of the appertaining pair of rows.

THE DRAWINGS

The invention will be explained in greater detail with reference to the drawings. In these drawings, which have been kept largely schematic:

THE PREFERRED EMBODIMENT

Figure 1:
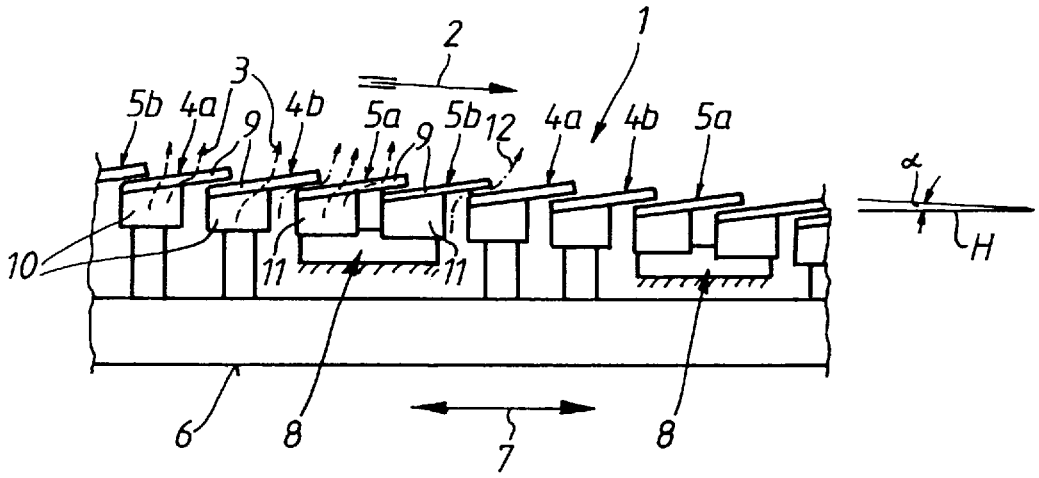
FIG. 1 shows a vertical longitudinal view through a longitudinal portion of the reciprocating grate according to the invention.

Although the reciprocating grate constructed according to the invention can be used generally for the treatment of different bulk materials which are transported by the grate along a path and through which suitable treatment gases flow upwards from below, in the following explanations it may be assumed that the illustrated reciprocating grate is in its particularly preferred form as a reciprocating grate cooler which is designed for cooling hot kiln feed material, such as for example cement clinker, coming from a burning arrangement, particularly a kiln such as a rotary kiln, and discharged onto this reciprocating grate.

The general construction of the reciprocating grate according to the invention or of the reciprocating grate cooler 1 will be described first of all with reference to the longitudinal portion of the grate illustrated in FIG. 1. In general the reciprocating grate 1 can be constructed in the manner illustrated and described below only over at least a selected longitudinal portion or also—as is generally preferred—over its entire length.

In this reciprocating grate according to the invention it may be assumed that cement clinker to be cooled is transported away in the longitudinal direction and thus in the direction of the arrow 2 over this grate and is cooled (treated) by means of cooling gases, particularly cooling air according to the broken arrows 3—as is known per se.

This reciprocating grate 1 contains a plurality of rows of grate plates 4*a*, 4*b*, 5*a*, 5*b* which are disposed behind one another along the part formed by the grate and of which the rows of grate plates 4*a*, 4*b* are movable to and fro in the longitudinal direction of the grate (arrow 2) by being disposed on a common driving frame 6 which for its part can be moved to and fro in the direction of the double arrow 7 with the aid of a drive which is not shown in greater detail but is known per se, i.e. this is a conventional driving frame 6 which swings to and fro. On the other hand the other rows of grate plates 5*a*, 5*b* are mounted fixed or stationary in the cooler housing or reciprocating grate housing which is merely indicated at 8.

All rows of grate plates 4*a*, 4*b*, 5*a*, 5*b* extending transversely or at right angles to the longitudinal direction of the grate (arrow 2) each contain a corresponding number of grate plates 9 which are arranged immediately adjacent to one another and transversely with respect to the longitudinal direction of the grate (arrow 2) and which can be constructed in any suitable manner which is known per se and have a plurality of gas openings for the passage of cooling air or treatment gas (arrows 3) on their upper face which comes into contact with bulk material or cement clinker. All grate plates 9 can be of generally similar construction; a particularly advantageous type of construction for these grate plates 9 is disclosed in EP-A-0 537 523. Irrespective of which type of grate plate is chosen, the grate plates 9 of rows of grate plates 4*a*, 4*b*, 5*a*, 5*b* which are adjacent to one another in the longitudinal direction (arrow 2) should overlap one another somewhat like scales, as can be seen in FIG. 1—but also in FIG. 2.

In this reciprocating grate 1 according to the invention it is particularly important that in at least one longitudinal portion of the grate, but preferably over the entire length of the grate, in each case at least two rows of grate plates 4*a*, 4*b* which are immediately adjacent to one another are movable conjointly to and fro in the direction of the double arrow 7 relative to at least one succeeding or downstream row of grate plates 5*a*, 5*b* in the longitudinal direction of the grate plates (arrow 2), that is to say in the present case relative to the stationary rows of grate plates. In this case, for reasons of practical workability it is particularly preferred if–as illustrated in the drawings–in each case two rows of grate plates 4*a*, 4*b* which are immediately adjacent to one another and are movable to and fro in the direction of the double arrow 7 are disposed so that in the longitudinal direction of the grate (arrow 2) they alternate in each case with two stationary rows of grate plates 5*a*, 5*b* which are immediately adjacent to one another, i.e. pairs of rows of grate plates 4*a*, 4*b* which are movable to and from and stationary rows of grate plates 5*a*, 5*b* alternate with one another in each case in the longitudinal direction of the grate (arrow 2). In this case–as already mentioned–the rows of grate plates 4*a*, 4*b* which are movable to and fro and co-ordinated in pairs in each case are disposed on the common driving frame 6. The grate plates 9 of each movable row of grate plates 4*a*, 4*b* and the grate plates 9 of each fixed row of grate plates 5*a*, 5*b* are fixed so as to be individually replaceable on separate grate plate supports 10 or 11 respectively which in each case belong only to one single row of grate plates 4*a*, 4*b*, 5*a*, 5*b* and for the delivery of a heat exchange medium, that is to say in this case for the delivery of cooling air (arrows 3), they are preferably constructed as hollow supports, as is also known per se for example from EP-A-0 537 523. The grate plate supports 10 for the rows of grate plates 4*a*, 4*b* which are movable to and fro are mounted on the driving frame 6 which swings to and fro and the grate plate supports 11 of the fixed rows of grate plates 5*a*, 5*b* are mounted stationary in the reciprocating grate housing 8.

Figure 2:
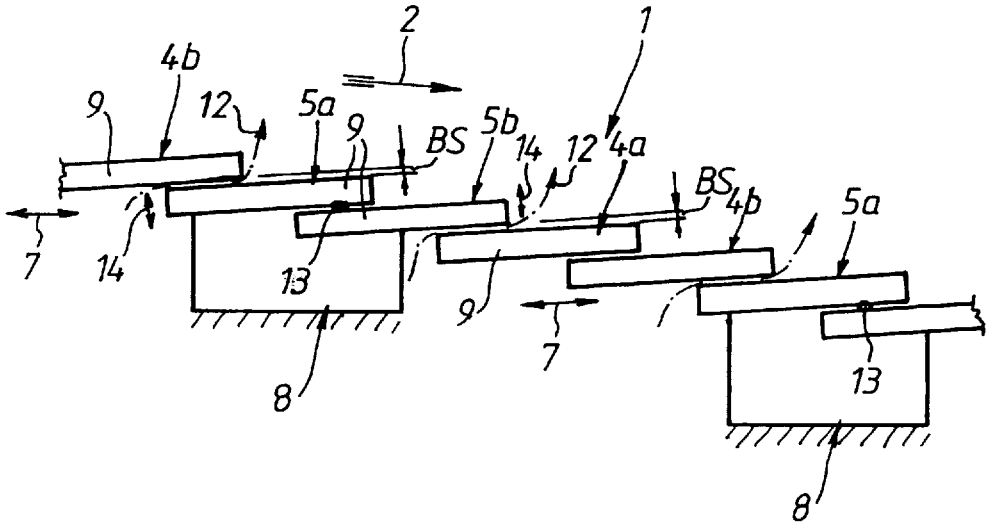
FIG. 2 shows an enlarged more schematic partial longitudinal view of the reciprocating grate for explanation of details.

The preceding description of the reciprocating grate 1 also applies essentially to the subsequent explanations of further details with reference to the more schematic representation in FIG. 2. In this it may be seen that at least the grate plates 9, which overlap like scales, of rows of grate plates (e.g. 4*b* and 5*a* or 5*b* and 4*a*) which are adjacent to one another in the longitudinal direction of the grate (arrow 2) and are movable relative to each other are disposed above one another whilst maintaining a gap for movement BS. This gap for movement BS serves for the delivery of so-called confining air (according to the dash-dot arrows 12) in order to cool the grate plates 9 in this gap region, to prevent fine bulk material or clinker from falling through and in order moreover to avoid cooling air or treatment gas flowing back from the bed of bulk material or the clinker bed into the lower part of the grate. In order that as little confining air as possible can be passed in a controlled manner through the gaps for movement BS, these gaps for movement should be set as small as possible.

According to the example illustrated with the aid of FIG. 2 the gaps for movement BS of rows of grate plates 4*b*/5*a*, 5*b*/4*a* which are movable relative to each other can be adjustable. For this purpose it may be assumed that the overlapping grate plates 9 of fixed rows of grate plates 5*a*, 5*b* which are in each case co-ordinated in pairs are connected to one another by contact numbers 13 between these overlapping grate plates 9. These contact numbers 13 can for example be of spherical, cylindrical or other similar construction and can be disposed in such a way that they form a kind of pivot axis between the grate plates 9 which connect them, this pivot axis extending substantially at right angles to the longitudinal axis of the grate or to the longitudinal direction of the grate according to the arrow 2. These grate plates 9 of the stationary rows of grate plates 5*a*, 5*b* which are in each case co-ordinated in pairs can be pivoted around this pivot axis independently of each other or each by itself according to the double arrow 14 and can thereby be adjusted. In this way all gaps for movement BS can be accurately set to the gap width or gap height which is necessary in each case and also can be reset or newly set if need be during the course of the operating life. Thus a very controlled delivery of precisely the necessary quantity of confining air can always be ensured.

With regard to the overlapping grate plates 9 in each pair of rows of grate plates 4*a*/4*b* and 5*a*/5*b* which belong together, a predetermined gap for confining air to pass through can likewise be set or not in adaptation to the particular operational requirements between these overlapping grate plates of each pair of rows. However, advantageously the overlapping grate plates 9 of each pair of rows should not be fixed to one another, in order to ensure easy installation and replacement.

Furthermore, depending upon the arrangement, co-ordination and direction of movement of the grate plates 9 or of the appertaining movable rows of grate plates 5*a*, 5*b*, the reciprocating grate 1 can be disposed so that its grate surface extends substantially horizontally in its longitudinal direction or is inclined overall downwardly at a shallow angle $\alpha$ (FIG. 1) of a few degrees relative to the horizontal H in the direction of the outlet end of the grate (to the right in FIG. 1).

We claim:

1. In a reciprocating grate construction for transporting bulk material along a path and treating such material with gas and comprising a plurality of rows of grate plates having gas openings therein and overlapping one another along said path, the rows of some of said grate plates being movable and the rows of others of said grate plates being stationary, the improvement wherein two adjacent rows of said movable grate plates are conjointly movable and alternate with two adjacent rows of said stationary grate plates.

2. The construction according to claim 1 wherein said adjacent rows of movable grate plates are mounted on a common drive frame.

3. The construction according to claim 1 wherein the grate plates of each of said rows are mounted on hollow supports through which said gas may pass, the supports of said grate plates of said movable rows of grate plates being movable conjointly and the supports of the grate plates of said stationary rows of grate plates being fixed.

4. The construction according to claim 1 wherein overlapping grate plates of said rows of movable and stationary grate plates have a gap therebetween.

5. The construction according to claim 4 wherein said gap is maintained by contact members interposed between said overlapping grate plates.

6. The construction according to claim 5 wherein said contact members enable relative pivotal movement of said overlapping grate plates about said contact members.

7. The construction according to claim 1 wherein said rows of grate plates form a substantially horizontal support surface for said bulk material.

8. The construction according to claim 1 wherein said rows of grate plates form a support surface for said bulk material which is inclined downward at a shallow angle along said path.

9. The construction according to claim 1 wherein said bulk material is relatively hot and wherein said gas is relatively cool.

10. In a reciprocating grate construction for transporting bulk material along a path and comprising a plurality of rows of grate plates overlapping one another along said path and forming a supporting surface for said bulk material, the grate plates of some of said rows being movable to and fro along said path and the grate plates of others of said rows being stationary, the improvement wherein the grate plates of two immediately adjacent movable rows of grate plates are movable conjointly relative to that row of stationary grate plates which is immediately adjacent said two immediately adjacent movable rows of grate plates.

11. The construction according to claim 10 wherein the row of stationary grate plates immediately adjacent the two immediately adjacent movable rows of grate plates is one of two immediately adjacent rows of stationary grate plates.

12. The construction according to claim 10 wherein the grate plates of said immediately adjacent movable rows are carried by a common support.

13. The construction according to claim 10 wherein overlapping grate plates of said rows of movable and stationary grate plates have a gap therebetween.

14. The construction according to claim 13 wherein said gap is maintained by contact members interposed between said overlapping grate plates.

15. The construction according to claim 14 wherein said contact members enable relative pivotal movement of said overlapping grate plates about said contact members.

16. The construction according to claim 10 wherein said rows of said grate plates form a substantially horizontal support surface for said bulk material.

17. The construction according to claim 10 wherein said rows of said grate plates form a support surface for said bulk material which is inclined downward at a shallow angle along said path.

* * * * *